US011761350B2

(12) United States Patent
Mariotti et al.

(10) Patent No.: US 11,761,350 B2
(45) Date of Patent: Sep. 19, 2023

(54) LUBRICATION SYSTEM FOR AERIAL VEHICLES

(71) Applicants: General Electric Company, Schenectady, NY (US); GE Aviation Czech s.r.o., Prague (CZ)

(72) Inventors: Gabriele Mariotti, Prague (CZ); Vladimir Soukup, Prague (CZ); Robert Burton Brown, Medford, MA (US); Emil Paul, Prague (CZ); Jakub Biganovsky, Prague (CZ); Martin Borovicka, Prague (CZ)

(73) Assignees: General Electric Company, Schenectady, NY (US); GE Aviation Czech s.r.o., Prague (CZ)

( * ) Notice: Subject to any disclaimer, the term of this patent is extended or adjusted under 35 U.S.C. 154(b) by 0 days.

(21) Appl. No.: 17/219,137

(22) Filed: Mar. 31, 2021

(65) Prior Publication Data

US 2022/0316360 A1 Oct. 6, 2022

(51) Int. Cl.

| | |
|---|---|
| ***F01D 25/20*** | (2006.01) |
| ***F01M 11/06*** | (2006.01) |
| ***F01M 13/04*** | (2006.01) |

(52) U.S. Cl.

CPC ..... *F01D 25/20* (2013.01); *F01M 11/065* (2013.01); *F01M 13/04* (2013.01); *F01M 2011/068* (2013.01); *F01M 2013/0444* (2013.01)

(58) Field of Classification Search

CPC ..... F01D 25/20; F01M 11/065; F01M 2011/068; F01M 2013/0444

USPC ..... 184/6.2

See application file for complete search history.

(56) References Cited

U.S. PATENT DOCUMENTS

| | | | | |
|---|---|---|---|---|
| 1,363,833 | A | 12/1920 | Boyd et al. | |
| 2,725,956 | A | 12/1955 | Cunningham | |
| 2,831,490 | A | 4/1958 | Simcock | |
| 2,934,077 | A | 4/1960 | Whiting | |
| 2,983,331 | A | 5/1961 | Helsley, Jr. | |
| 3,486,582 | A | 12/1969 | Carter et al. | |
| 3,658,153 | A | 4/1972 | Berman | |
| 4,093,428 | A | 6/1978 | Swogger | |
| 4,511,016 | A * | 4/1985 | Doell | F01D 25/20 184/6.28 |
| 4,947,963 | A * | 8/1990 | Aho, Jr. | F01D 25/18 244/135 R |
| 8,051,869 | B2 | 11/2011 | Parnin et al. | |
| 8,601,785 | B2 | 12/2013 | Legare | |
| 9,441,786 | B2 | 9/2016 | Streifinger | |

(Continued)

FOREIGN PATENT DOCUMENTS

| | | |
|---|---|---|
| GB | 159847 | 5/1921 |
| GB | 319741 | 12/1930 |

*Primary Examiner* — Lindsay M Low
*Assistant Examiner* — Omar Morales
(74) *Attorney, Agent, or Firm* — Dority & Manning, P.A.

(57) ABSTRACT

A lubrication system for an aerial vehicle, the lubrication system including: a lubrication oil (LO) tank configured to operate at a first internal pressure; and an intake chamber (IC) configured to operate at a second internal pressure greater than the first internal pressure, the IC including an ingress port configured to receive LO from a sump of an equipment of the aerial vehicle; an overflow port in fluid communication with the LO tank; and a supply port in fluid communication with the sump and configured to supply LO to the sump.

13 Claims, 3 Drawing Sheets

(56) References Cited

U.S. PATENT DOCUMENTS

| | | | |
|---|---|---|---|
| 10,107,197 | B2 | 10/2018 | Parnin et al. |
| 10,393,313 | B2 | 8/2019 | Beier et al. |
| 2019/0178119 | A1 | 6/2019 | Karcher |

* cited by examiner

LUBRICATION SYSTEM FOR AERIAL VEHICLES

FIELD

The present subject matter relates generally to lubrication systems for aerial vehicles, and more particularly to lubrication systems for aerial vehicles that operate at various attitudes with respect to gravitational force.

BACKGROUND

Aerial vehicles can undergo significant loading conditions under certain maneuvers which can starve oil supply to one or more portions of the engine. That is, lubrication oil used on equipment in the aerial vehicle can be compromised by pressure loss and aeration due to excessive directional forces associated with certain aerial maneuvers. For example, when an aerial vehicle pulls high G-loads, e.g., when performing quick turns and attitude adjustments, lubrication oil may pool in one or more areas of the lubrication oil system whereby the lubrication oil is not sufficiently distributed to equipment of the aerial vehicle. Similarly, when flying at certain attitudes with respect to gravitational force the lubrication oil system can similarly starve lubrication oil to said equipment as a result of inlet/outlet locations which are not actively submerged in lubrication oil.

As a result, equipment of the aerial vehicle can become damaged, components can become prematurely worn, and operational lifespan of the equipment can be reduced. As such, improvements in lubrication oil systems for aerial vehicles are desired by the aerial vehicle industry.

BRIEF DESCRIPTION

Aspects and advantages of the invention will be set forth in part in the following description, or may be obvious from the description, or may be learned through practice of the invention.

In one exemplary embodiment of the present disclosure, a lubrication system for an aerial vehicle, the lubrication system comprising: a lubrication oil (LO) tank configured to operate at a first internal pressure; and an intake chamber (IC) configured to operate at a second internal pressure greater than the first internal pressure, the IC comprising: an ingress port configured to receive LO from a sump of an equipment of the aerial vehicle; an overflow port in fluid communication with the LO tank; and a supply port in fluid communication with the sump and configured to supply LO to the sump.

According to another exemplary embodiment, an aerial vehicle comprising: equipment comprising a sump configured to receive lubrication oil (LO); a lubrication system in fluid communication with the sump and configured to continuously supply LO to the sump at a generally constant pressure independent of an attitude of the aerial vehicle with respect to gravitational force.

According to another exemplary embodiment, a method of installing a lubrication system in an aerial vehicle, the method comprising: providing an intake chamber (IC) in the aerial vehicle such that an ingress port of the IC is in fluid communication with lubrication oil (LO) exiting a sump of an equipment of the aerial vehicle; fluidly coupling an overflow port of the IC to a LO tank of the aerial vehicle; and fluidly coupling a supply port of the IC to the sump, the IC being configured to supply LO to the sump.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
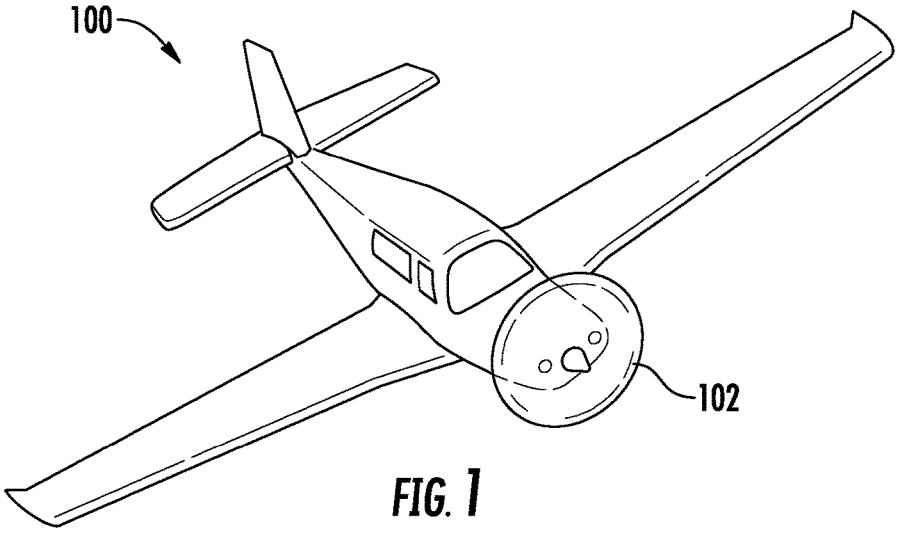
FIG. 1 is a perspective view of an aerial vehicle in accordance with an exemplary embodiment of the present disclosure.

Repeat use of reference characters in the present specification and drawings is intended to represent the same or analogous features or elements of the present invention.

DETAILED DESCRIPTION

Reference now will be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

The word "exemplary" is used herein to mean "serving as an example, instance, or illustration." Any implementation described herein as "exemplary" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The singular forms "a," "an," and "the" include plural references unless the context clearly dictates otherwise. The terms "coupled," "fixed," "attached to," and the like refer to both direct coupling, fixing, or attaching, as well as indirect coupling, fixing, or attaching through one or more intermediate components or features, unless otherwise specified herein.

The terms "forward" and "aft" refer to relative positions within a gas turbine engine or vehicle, and refer to the normal operational attitude of the gas turbine engine or vehicle. For example, with regard to a gas turbine engine, forward refers to a position closer to an engine propeller or exhaust and aft refers to a position closer to an engine inlet. The terms "upstream" and "downstream" refer to the relative direction with respect to fluid flow in a fluid pathway. For example, "upstream" refers to the direction from which the fluid flows, and "downstream" refers to the direction to which the fluid flows.

Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 1, 2, 4, 10, 15, or 20 percent margin. These approximating margins may apply to a single value, either or both endpoints defining numerical ranges, and/or the margin for ranges between endpoints.

Here and throughout the specification and claims, range limitations are combined and interchanged, such ranges are identified and include all the sub-ranges contained therein unless context or language indicates otherwise. For example, all ranges disclosed herein are inclusive of the endpoints, and the endpoints are independently combinable with each other.

In general, embodiment of the present disclosure described herein are directed to lubrication systems for aerial vehicles. The lubrication systems are configured to supply one or more sumps of equipment of the aerial vehicle with lubrication oil (LO) at a generally constant pressure independent of attitude of the aerial vehicle with respect to gravitational force. Accordingly, lubrication systems described herein may be particularly useful for aerial vehicles configured to operate a wide range of attitudes. Exemplary aerial vehicles include acrobatic airplanes which operate at high G-loads and throughout all attitudes of orientation.

Referring to the figures, FIG. 1 illustrates an exemplary aerial vehicle 100 in accordance with one or more embodiments described herein. The aerial vehicle 100 depicted in FIG. 1 is an acrobatic airplane configured to operate over a wide range of attitudes and G-loads. The aerial vehicle 100 includes an engine, such as turboprop engine 200 (FIG. 2) powering a propeller 102 configured to generate thrust. In an embodiment, the aerial vehicle 100 has a power rating of at least 500 horsepower (HP), such as at least 550 HP, such as at least 600 HP, such as at least 650 HP, such as at least 700 HP, such as at least 750 HP, such as at least 800 HP, such as at least 850 HP.

Figure 2:
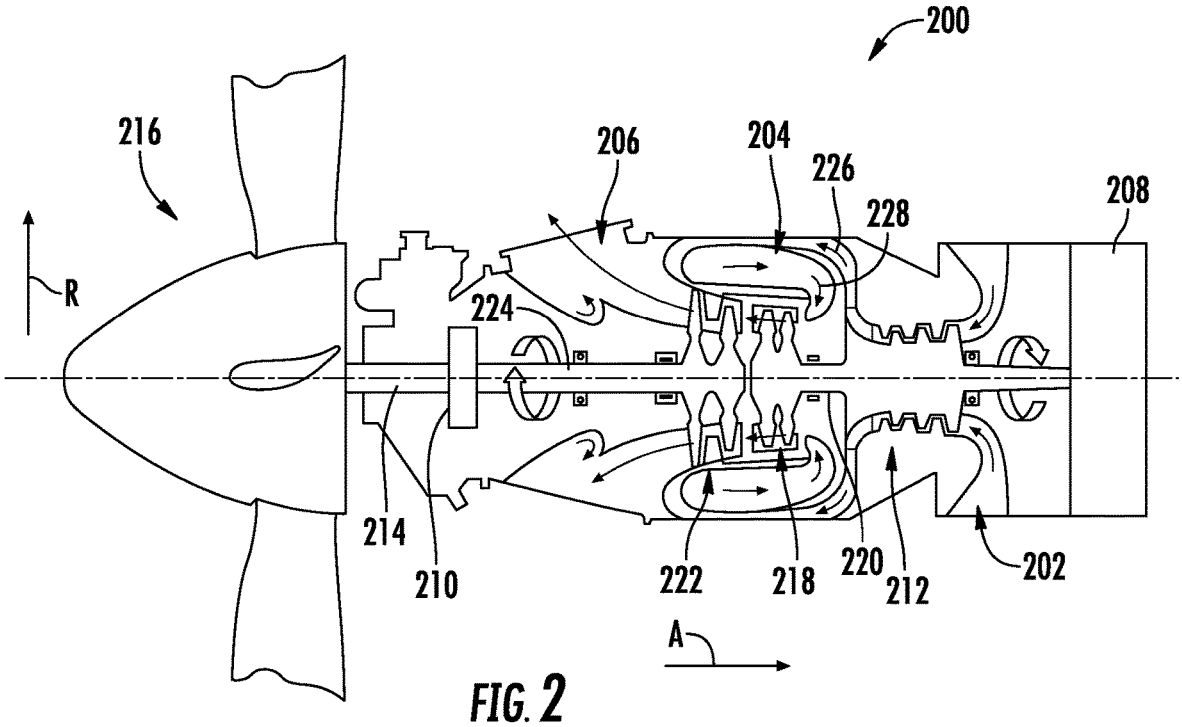
FIG. 2 is a cross-sectional view of an exemplary engine in accordance with an exemplary embodiment of the present disclosure.

Referring to FIG. 2, the turboprop engine 200 generally includes an air inlet 202 configured to supply air to a combustion chamber 204. An exhaust 206 is configured to exhaust gas from the turboprop engine 200. More specifically, the turboprop engine 200 includes a compressor 212 configured to receive air from the air inlet 202 and compress the air. The compressed air from the compressor 212 is provided to the combustion chamber 204, where the compressed air is combusted with fuel to generate combustion gasses. The combustion gasses are provided to a first turbine 218, where the combustion gasses are expanded to rotate the first turbine 218, which in turn drives the compressor 212 through a first shaft 220. The combustion gassed then flow to a second turbine 222, where the combustion gasses are further expanded to rotate the second turbine 222, which in turn drives a second shaft 224. The second shaft 224 drives a propeller shaft 214 across a reduction gearbox 210, and the propeller shaft 214 drives a propeller 216.

The turboprop engine 200 further includes an accessory gear box 208. The accessory gearbox 208 is driven by the first shaft 220. The accessory gearbox 208 may provide power to one or more accessory systems for the engine 200 and/or aerial vehicle 100 incorporating the engine 200.

Although not depicted, the engine 200 and aerial vehicle 100 can further include a controller for controlling operation of the engine 200, for example, an electronic engine control system (EECS) connected to a control lever.

It should be understood that the turboprop engine 200 depicted in FIG. 2 is merely exemplary of an engine in which the lubrication systems described herein can be utilized. In accordance with other embodiments, the engine can include additional or other features and/or components or an entirely different engine type, e.g., turboshaft, turbofan, turbojet, etc.

Although not expressly depicted, and as is described in greater detail hereinafter, the engine 200 is equipped with a lubrication oil (LO) system which avoids oil starvation that may occur in traditional engines, such as during certain aircraft maneuvers. More specifically, the LO system can avoid oil starvation which might occur in traditional engines during momentary occurrence of high absolute G-loads (e.g., at −4 Gs or at 7 Gs) and/or at attitudes in excess of 10° relative to gravitational force, such as attitudes in excess of 15° relative to gravitational force, such as attitudes in excess of 20° relative to gravitational force, such as attitudes in excess of 25° relative to gravitational force, such as attitudes in excess of 30° relative to gravitational force, such as attitudes in excess of 35° relative to gravitational force, such as attitudes in excess of 40° relative to gravitational force, such as attitudes in excess of 45° relative to gravitational force, such as attitudes in excess of 50° relative to gravitational force, such as attitudes in excess of 55° relative to gravitational force, such as attitudes in excess of 60° relative to gravitational force, such as attitudes in excess of 65° relative to gravitational force, such as attitudes in excess of 70° relative to gravitational force, such as attitudes in excess of 75° relative to gravitational force, such as attitudes in excess of 80° relative to gravitational force, such as attitudes in excess of 85° relative to gravitational force, such as attitudes in excess of 90° relative to gravitational force. At occurrence of attitudes in excess of the aforementioned angles, or during high absolute G-loads, traditional engines may incur oil starvation as a result of displacement of the LO relative to the system. For example, when flying at high attitudes relative to gravitational force, e.g., upside down, LO may displace from a lower side of the engine, or associated component, to a high side thereof. This can result in momentary loss of LO pressure which can affect performance of the engine or even cause damage to the engine and/or one or more components thereof. Embodiments of LO systems described herein are intended to prevent oil starvation and/or functional control loss (e.g., propeller control or hydraulic torque measuring) under all intended aircraft maneuvers.

As described in greater detail hereinafter, the engine 200 can include a dry sump with a multi-attitude LO tank. In an embodiment, the multi-attitude LO tank can be integrated into the accessory gear box 208. The multi-attitude LO tank can be referred to as an intake chamber (IC). The IC can provide pressurized and filtered LO for lubricating and cooling parts of the engine 200, such as bearings and gears. In certain instances, pressurized LO can also be used as hydraulic fluid for torque measurement in the reduction gearbox 210 and/or for propeller speed control. In yet other instances, the pressurized LO can be used for failure detection as debris, e.g., worn particulate, can be transmitted by the pressurized LO to a signalization system (not shown).

Figure 3:
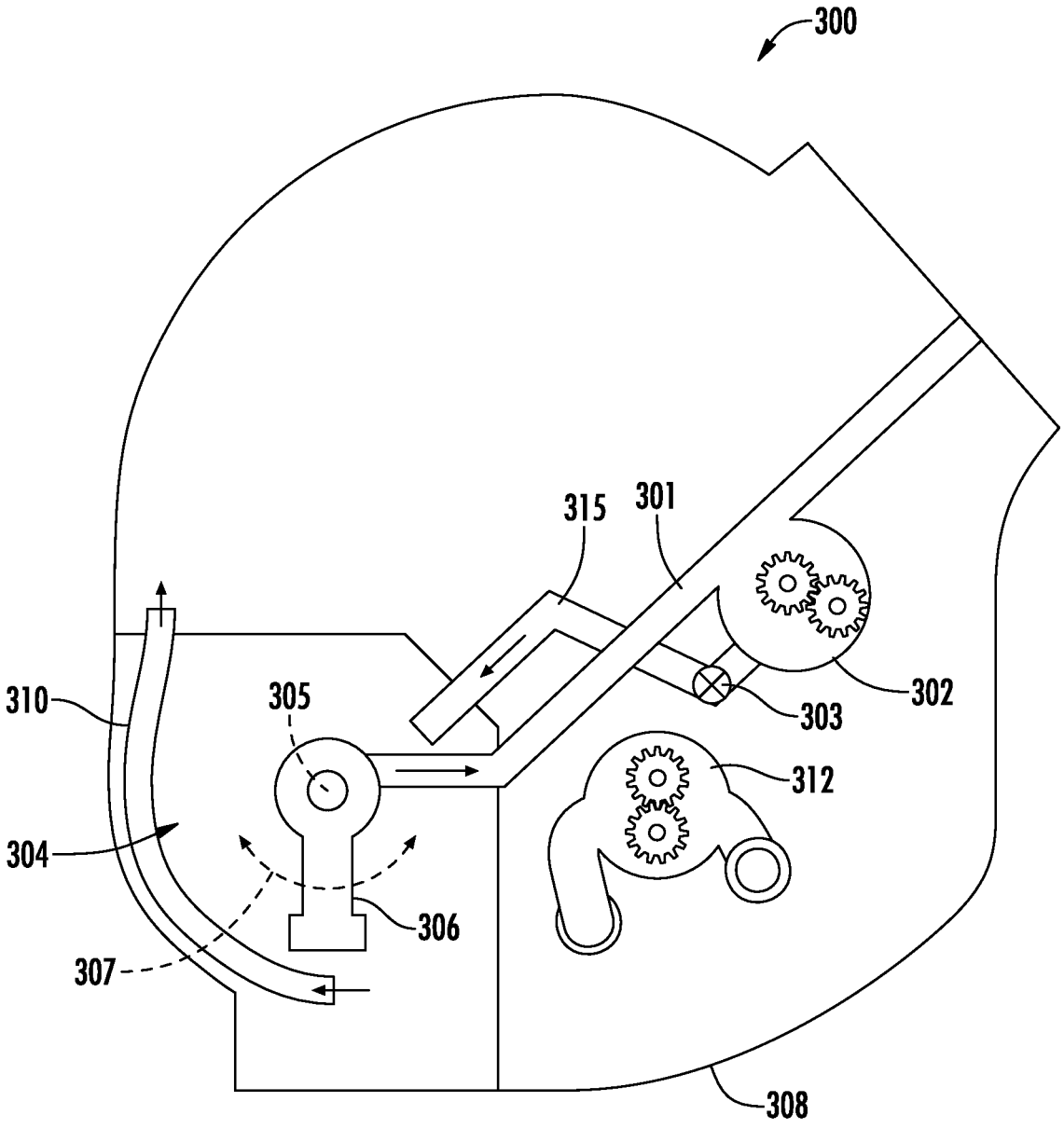
FIG. 3 is a cross-sectional view of a lubrication oil system in accordance with an exemplary embodiment of the present disclosure.

FIG. 3 illustrates a cross-sectional view of a lubrication system 300 in accordance with an embodiment. The lubrication system 300 provides pressurized, and optionally filtered, LO to nozzles (not shown) for lubricating, e.g., bearings and gears as well for providing, e.g., lubrication at inlet gear pumps of a propeller regulating system and torque measurement system. It should be understood that the lubrication system 300 can further perform additional functions within the aerial vehicle 100. Further the lubrication system 300 may be incorporated into the accessory gearbox 208 of the engine 200 of FIG. 2, or may be incorporated in any other suitable manner into an engine (e.g., any other suitable turboprop engine, turbofan engine, turboshaft engine, etc.).

The lubrication system 300 as seen in FIG. 3 can include a main supply pump 302 configured to bias LO to one or more lubrication points of the engine 200, e.g., the aforementioned bearings and gears, through an outlet line 301. In an exemplary embodiment, the main supply pump 302 can include a gear-type pump including a plurality of gears configured to mesh and pump LO through displacement. The gear-type pump can include an external gear pump or an internal gear pump. In an embodiment, the main supply pump 302 can be a single-stage gear pump. The main supply pump 302 can include fixed faces with a gear shaft lubricated by LO. In other non-limiting embodiments, the main supply pump 302 can include a vane pump. LO biased by the main supply pump 302 can pass through one or more filters and/or pressure regulating valves prior to contacting the lubrication points of the engine 200.

In an embodiment, an inlet of the main supply pump 302 is fluidly coupled to the IC 304 through the outlet line 301. In such a manner, the main supply pump 302 can bias LO from the IC 304 to the lubrication points. A rotating inlet pick up 306 can be disposed within the IC 304 and fluidly couple the main supply pump 302 with the IC 304. The rotating inlet pick up 306 can rotate about a pivot point 305 in a direction 307 relative to the IC 304. By way of example, the rotating inlet pick up 306 can be configured to rotate at least 5° about the pivot point 305 relative to the IC 304, such as at least 10° relative to the IC 304, such as at least 15° relative to the IC 304, such as at least 20° relative to the IC 304, such as at least 30° relative to the IC 304, such as at least 40° relative to the IC 304, such as at least 50° relative to the IC 304, such as at least 60° relative to the IC 304, such as at least 70° relative to the IC 304, such as at least 80° relative to the IC 304, such as at least 90° relative to the IC 304. Rotation of the rotating inlet pick up 306 can occur through gravitational forces, one or more motors, or a combination thereof. The rotating inlet pick up 306 can include a strainer or other filter (not shown) configured to remove debris from the LO to protect the equipment of the engine 200.

In an embodiment, the IC 304 can be disposed at least partially within an LO tank 308 of the lubrication system 300. More particularly, the IC 304 can be fully disposed within the LO tank 308. The LO tank 308 can define a main reservoir for LO within the aerial vehicle 100. In an embodiment, the LO tank 308 can act as overflow relief for LO passing through the IC 304. For example, in one or more embodiments the IC 304 can include an overflow port 310 in fluid communication with the LO tank 308. As LO is biased into the IC 304 (as described in greater detail hereinafter), overflow LO, i.e., excess LO, can enter the LO tank 308 through the overflow port 310. In certain instances, the overflow port 310 can define a static geometry and/or size. In other instances, the overflow port 310 can define a variable geometry and/or size. Alternatively, the overflow port 310 can be interchangeable between a plurality of different shapes and/or sizes. Use of an interchangeable or variable overflow port 310 can permit selective pressurization of the IC 304 which in turn can impact efficiency of LO delivery and backpressure within the lubrication system 300.

In certain instances, the overflow port 310 can be configured to pass a flow of LO into the LO tank 308 from the IC 304 at substantially all times during operation of the aerial vehicle 100. In an embodiment, the overflow port 310 can pass LO into the LO tank 308 at all times during operation. In such a manner, the lubrication system 300 can remain at a desired pressure without occurrence of oil starvation.

The IC 304 defines a first internal volume for receiving LO while the LO tank 308 defines a second internal volume for receiving LO. In an embodiment, the first volume of the IC 304 can be less than the second volume of the LO tank 308. By way of example, the first volume can be less than 95% the second volume, such as less than 90% the second volume, such as less than 75% the second volume, such as less than 50% the second volume, such as less than 25% the second volume.

LO disposed within the LO tank 308 but not the IC 304 may be part of a makeup fluid circuit to be recirculated to the IC 304. In accordance with an embodiment, the main supply pump 302 is not in direct fluid communication with LO disposed within the LO tank 308 but outside of the IC 304. However, the main supply pump 302 can be in direct fluid communication with LO disposed within the IC 304.

In an embodiment, the lubrication system 300 can further include an LO scavenge system including a plurality of scavenge pumps 312 configured to bias LO within the lubrication system 300. In certain instances, all of the scavenge pumps 312 can include a similar, or same, configuration as compared to one another. In other instances, at least two of the scavenge pumps 312 can be different from one another. The scavenge pumps 312 can include similar or different configurations as compared to the main supply pump 302. In a particular embodiment, at least one of the scavenge pumps 312 includes a gear-type pump including a plurality of gears configured to mesh and pump LO through displacement. The gear-type pump can include an external gear pump or an internal gear pump.

The scavenge system, e.g., the scavenge pumps 312, can be configured to bias the LO back to the IC 304 after circulating through equipment of the aerial vehicle 100 (as described in greater detail hereinafter).

Figure 4:
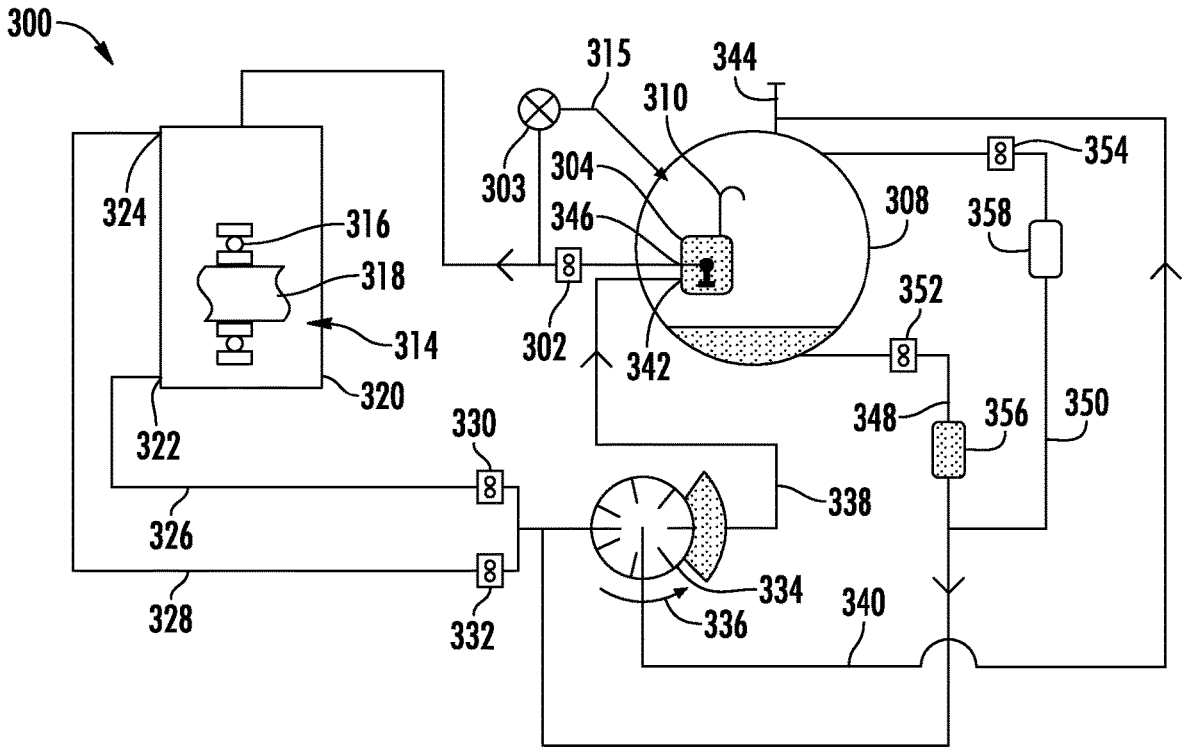
FIG. 4 is a schematic view of a lubrication oil system in accordance with an exemplary embodiment of the present disclosure.

FIG. 4 illustrates a schematic view of the lubrication system 300 in accordance with an exemplary embodiment. As described above, the lubrication system 300 can be used to provide LO to equipment 314 of the aerial vehicle 100. The equipment 314 can include, for example, bearings, gears, and/or other components of the engine 200 and/or a non-engine related component of the aerial vehicle 100. By way of example, the equipment 314 can have one or more dispensers, e.g., nozzles, (not illustrated) of the lubrication system 300 positioned relative to the equipment 314 so as to dispense LO to one or more desired locations along the equipment 314. In the illustrated embodiment, the equipment 314 being lubricated includes a bearing assembly 316 configured to permit low-friction rotation of a shaft 318. In certain exemplary embodiments, the shaft 318 may be one of the first shaft 220, the second shaft 224, or the propeller shaft 214 described above with respect to FIG. 2. Alternatively, however, the shaft 318 may be any other suitable shaft, and/or the bearing assembly 316 may support any other suitable rotating member.

Referring still to FIG. 4, the bearing assembly 316 and at least a portion of the shaft 318 can be disposed within a sump 320. The sump 320 can include an internal volume in which the bearing assembly 316 and the at least a portion of the shaft 318 are disposed within. The sump 320 can define one or more areas into which LO can collect. These areas can include portions of the sump 320 at which can be disposed one or more egress ports, such as a first egress port 322 and a second egress port 324. The first and second egress ports 322 and 324 can be in fluid communication with the internal volume of the sump 320, permitting egress of LO from the sump 320. As illustrated, the first and second egress ports 322 and 324 can be generally spaced apart from one another. For example, the first egress port 322 can be disposed on a first side of the sump 320, e.g., a lower side of the sump 320, and the second egress port 324 can be disposed on a second side of the sump 320, e.g., an upper side of the sump 320. In a more particular embodiment, the first and second egress ports 322 and 324 can be disposed at locations configured to collect LO at various different attitudes of the aerial vehicle 100. The first and second egress ports 322 and 324 can permit LO egress from the sump 320 regardless of attitude of the aerial vehicle 100, as measured with respect to gravitational force.

The first egress port 322 can be in fluid communication with a first fluid passageway 326. Similarly, the second egress port 324 can be in fluid communication with a second fluid passageway 328. The first and second fluid passageways 326 and 328 can extend in parallel from the sump 320 and join together downstream thereof. When the aerial vehicle 100 is operating at a first attitude, LO in the sump 320 can exit through the first egress port 322 and pass through the first fluid passageway 326. When the aerial vehicle 100 maneuvers resulting in a second attitude, LO in the sump 320 can exit through the second egress port 322 and pass through the second fluid passageway 328. In certain instances, maneuvers by the aerial vehicle 100 may cause LO egress to move entirely from one of the first and second egress ports 322 and 324 to the other thereof. However, in many instances, egress of LO from the sump 320 can include use of both the first and second egress ports 322 and 324 simultaneously at varying rates. That is, the first and second egress ports 322 and 324 can both facilitate egress of LO from the sump 320 at varying relative ratios based on the maneuvering of the aerial vehicle 100.

Disposed along the first fluid passageway 326 is a first scavenge pump 330 of the scavenge system. The first scavenge pump 330 can be part of the aforementioned plurality of scavenge pumps 312. The first scavenge pump 330 can bias LO through the first fluid passageway 326. Similarly, disposed along the second fluid passageway 328 is a second scavenge pump 332 of the scavenge system. The second fluid passageway 328 can be part of the aforementioned plurality of scavenge pumps 312. The second scavenge pump 332 can bias LO through the second fluid passageway 328. In alternate embodiments, LO within the first and second fluid passageways 326 and 328 can be biased by a different scavenge pump arrangement. For example, the first and second fluid passageways 326 and 328 can join together upstream of a common scavenge pump. In an embodiment, the first and second scavenge pumps 330 and 332 can be configured to generate biasing force within the first and second fluid passageways 326 and 328, respectively, only upon occurrence of a condition, e.g., upon detection of LO within the passageway, upon occurrence of certain threshold acceleration forces, upon detection of attitude changes, and the like.

In certain instances, the sump 320 may not have a vent for venting air therefrom. Thus, air entering the sump 320, e.g., through a labyrinth seal, can be removed from the sump 320 together with the LO. LO exiting the sump 320 and entering the first and/or second fluid passageways 326 and/or 328 may include air from the sump 320 in the form of air bubbles, air pockets, and the like. The air from the sump 320 can travel through the first and/or second fluid passageways 326 and/or 328 and be biased by the first and/or second scavenge pumps 330 and/or 332.

An oil-air separator 334, sometimes referred to as a deaerator, can be disposed in the fluid circuit of the lubrication system 300 so as to separate the air exiting the sump 320 from the LO. In an embodiment, the oil-air separator can be disposed downstream of the first and second scavenge pumps 330 and 332 or downstream of the plurality of scavenge pumps 312 referenced with respect to FIG. 3. In the illustrated embodiment, the oil-air separators 334 can include a rotating de-aerating system configured to separate oil and air upon occurrence of centripetal force. Upon rotating, e.g., in direction 336, air and LO can be separated from one another and moved through the lubrication system 300 via different routes. The LO can exit the oil-air separator 334 and pass through an LO passageway 338 while air can exit the oil-air separator 334 and pass through a separate air passageway 340.

The LO passageway 338 can be in fluid communication with the aforementioned IC 304. More particularly, the LO passageway 338 can be in direct fluid communication with the IC 304 through an ingress port 342 of the IC 304. Meanwhile, air contained within the air passageway 340 can be vented to an external environment through a vent 344.

LO within the IC 304 can be relatively pressurized. For instance, an internal pressure within the IC 304 can be greater than approximately 1 standard atmosphere, such as greater than approximately 1.25 standard atmospheres, such as greater than approximately 1.5 standard atmospheres, such as greater than approximately 1.75 standard atmospheres, such as greater than approximately 2 standard atmospheres, such as greater than approximately 2.5 standard atmospheres, such as greater than approximately 3 standard atmospheres, such as greater than approximately 4 standard atmospheres, such as greater than approximately 5 standard atmospheres, such as greater than approximately 6 standard atmospheres, such as greater than approximately 7 standard atmospheres, such as greater than approximately 8 standard atmospheres, such as greater than approximately 9 standard atmospheres, such as greater than approximately 10 standard atmospheres. As such, LO within the IC 304 can be maintained under pressure.

In an embodiment, the LO tank 308 can be configured to operate at a first internal pressure while the IC 304 can be configured to operate at a second internal pressure different from the first internal pressure. In a more particular embodiment, the second internal pressure can be greater than the first internal pressure. By way of example, the second internal pressure can be at least 101% the first internal pressure, such as at least 105% the first internal pressure, such as at least 110% the first internal pressure, such as at least 115% the first internal pressure, such as at least 120% the first internal pressure, such as at least 125% the first internal pressure, such as at least 130% the first internal pressure, such as at least 135% the first internal pressure, such as at least 140% the first internal pressure, such as at least 145% the first internal pressure, such as at least 150% the first internal pressure.

Maintenance of pressure within the IC 304 can be achieved, for example, by pressurizing LO through the ingress port 342 of the IC 304 to a first pressure, $P_1$. Meanwhile the overflow port 310 can permit LO to overflow from the IC 304 into the LO tank 308 at a second pressure, $P_2$. A supply port 346 extending to the main supply pump 302 can permit LO to exit the IC 304 at a third pressure, $P_3$. Through balancing $P_1$, $P_2$, and $P_3$ it may be possible to achieve a desired internal pressure within the IC 304. That is, in accordance with an embodiment, $P_1$ can be generally equal to a sum of $P_2$ and $P_3$ [$P_1=P_2+P_3$]. By raising $P_1$, $P_2$ and/or $P_3$ must be raised by an equal amount to maintain a constant pressure within the IC 304. Conversely, by lowering $P_1$, $P_2$ and/or $P_3$ must be lowered by an equal amount to maintain a constant pressure within the IC 304. Thus, it is possible to increase pressure in the IC 304 by raising $P_1$ while maintaining $P_2$ and $P_3$ at fixed values or decreasing either or both $P_2$ and/or $P_3$ while maintaining $P_1$ at a fixed value. Similarly, it is possible to decrease pressure in the IC 304 by lowering $P_1$ while maintaining $P_2$ and $P_3$ at fixed values or increasing either or both $P_2$ and/or $P_3$ while maintaining $P_1$ at a fixed value. In certain instances, it may be possible to define a generally constant internal pressure within the IC 304 through selection of a proper overflow port 310. That is, for example, by restricting LO flowrate through the overflow port 310 to a desired amount, the internal pressure within the IC 304 can be maintained. In a preferred embodiment, $P_3$ can remain generally constant at all times, or essentially all times, during operation of the aerial vehicle 100.

With the IC 304 generally constantly pressurized, risk of oil starvation at equipment 314 is greatly reduced during certain aerial maneuvers. That is, whereas traditional lubrication systems may incur momentary lapse of oil pressure resulting from oil within the traditional LO tank sloshing and thereby potentially uncovering a supply port for air consumption, by maintaining a pressurized IC 304, it is possible to prevent such momentary lapse of oil pressure.

In certain embodiments, the lubrication system 300 can further include an LO bypass port 315. The LO bypass port 315 can be disposed in fluid communication between the supply port 346 and the sump 320. The LO bypass port 315 can include a controller, e.g., a regulating valve 303, to control LO supply pressure to the sump 320. LO can be selectively permitted through the LO bypass port 315 so as to accommodate desired LO supply pressure.

LO within the lubrication system 300 can be further circulated through a makeup fluid circuit. The makeup fluid circuit can include, for example, one or more makeup fluid passageways, e.g., a first makeup fluid passageway 348 and a second makeup fluid passageway 350, in fluid communication with the LO tank 308. The first and second makeup fluid passageways 348 and 350 can be fluidly coupled with generally opposite sides of the LO tank 308. For instance, the first makeup fluid passageway 348 can be fluidly coupled with a lower end of the LO tank 308 while the second makeup fluid passageway 350 can be fluidly coupled with an upper end of the LO tank 308. Thus, similar to the first and second fluid passageways 326 and 328 described above with respect to the sump 320, at least one of the first and second makeup fluid passageways 348 and 350 can draw LO from the LO tank 308 regardless of aerial maneuvers being performed.

The first and second makeup fluid passageways 348 and 350 can further be in fluid communication upstream of the IC 304. For example, in an embodiment, the first and second makeup fluid passageways 348 and 350 can be fluidly coupled upstream of the oil-air separator 334. Accordingly, LO from the LO tank 308 can be recirculated through the makeup fluid circuit back to the IC 304 and pass through the oil-air separator 334 where air from the LO tank 308 can be vented through the vent 344 to the external environment.

The first and second makeup fluid passageways 348 and 350 can each include a makeup pump 352 and 354, respectively to bias LO from the LO tank 308. Moreover, each of the first and second makeup fluid passageways 348 and 350 can include a temporary LO storage volume 356 and 358, respectively, to maintain LO within the makeup fluid circuit and ready for dispensing upon occurrence of a condition requiring additional LO to the IC 304. That is, with LO already in the makeup fluid circuit, it is possible to further reduce delay that may occur upon certain aerial maneuvers which can cause oil starvation.

Use of lubrication systems 300 in accordance with one or more embodiments described herein can exhibit more uniform distribution of LO under a wider range of operating conditions as compared to traditional lubrication systems 300. In certain instances, lubrication systems 300 described herein can maintain a generally constant supply of LO to equipment under all safe operating conditions of the aerial vehicle 100. In an embodiment, the lubrication system 300 can be configured to supply a generally constant pressure of LO to the sump of the equipment. By way of example, the lubrication system 300 can be configured to deviate from a desired pressure for the equipment being lubricated by less than 1 pound per square inch (PSI) during operation of the aerial vehicle, such as by less than 0.75 PSI during operation of the aerial vehicle, such as by less than 0.5 PSI during operation of the aerial vehicle, such as by less than 0.25 PSI during operation of the aerial vehicle, such as by less than 0.2 PSI during operation of the aerial vehicle, such as by less than 0.15 PSI during operation of the aerial vehicle, such as by less than 0.1 PSI during operation of the aerial vehicle. Moreover, the lubrication system 300 can be configured to distribute the LO to the equipment at a fluid ratio [LO:air], as described by a volumetric ratio of LO to air, of no less than 5:1, such as no less than 10:1, such as no less than 15:1, such as no less than 20:1, such as no less than 30:1, such as no less than 50:1. Higher fluid ratios may be indicative of improved equipment performance and/or prolonged operational lifespan of the equipment.

Figure 5:
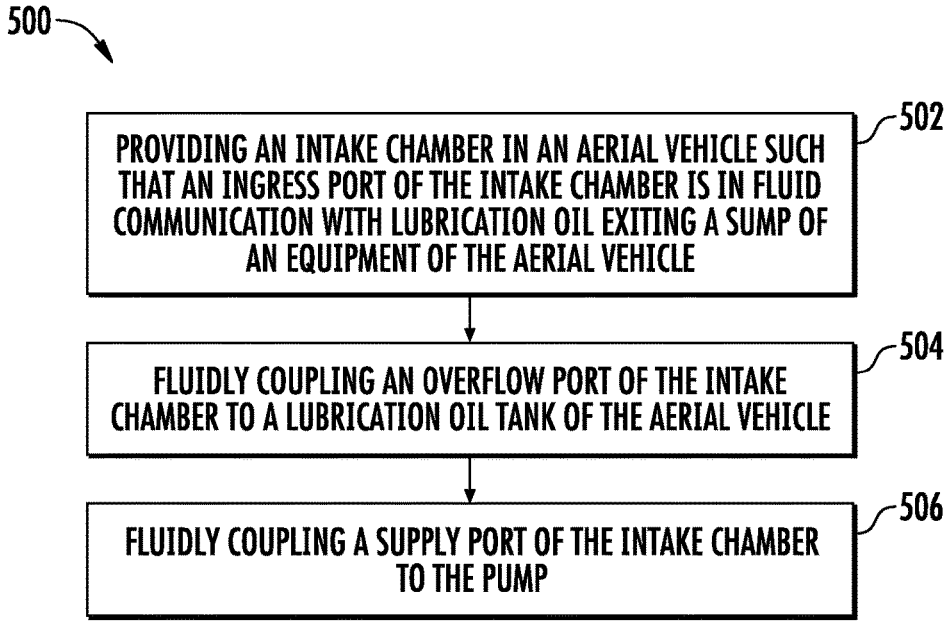
FIG. 5 illustrates an exemplary method of installing a lubrication system in an aerial vehicle in accordance with an exemplary aspect of the present disclosure.

FIG. 5 illustrates an exemplary method 500 of providing a lubrication system in an aerial vehicle. The method 500 can include a step 502 of providing an intake chamber (IC) in the aerial vehicle such that an ingress port of the IC is in fluid communication with lubrication oil (LO) exiting a sump of an equipment of the aerial vehicle. In an embodiment the step 502 of providing the IC in the aerial vehicle can be performed such that the IC is provided at least partially, such as fully, within a volume defined by the LO tank. The method 500 can further include a step 504 of fluidly coupling an overflow port of the IC to an LO tank of the aerial vehicle. The method 500 can further include a step 506 of fluidly coupling a supply port of the IC to the sump.

In an embodiment, the lubrication system can be retrofit into an existing aerial vehicle. That is, the lubrication system can be provided on an existing aerial vehicle post-production for purpose of improving the supply of LO to equipment thereof. In another embodiment, the lubrication system can be provided in an aerial vehicle during primary production thereof.

Further aspects of the invention are provided by the subject matter of the following clauses:

Embodiment 1. A lubrication system for an aerial vehicle, the lubrication system comprising: a lubrication oil (LO) tank configured to operate at a first internal pressure; and an intake chamber (IC) configured to operate at a second internal pressure greater than the first internal pressure, the IC comprising: an ingress port configured to receive LO from a sump of an equipment of the aerial vehicle; an overflow port in fluid communication with the LO tank; and a supply port in fluid communication with the sump and configured to supply LO to the sump.

Embodiment 2. The lubrication system of any one or more of the embodiments, wherein the IC is configured to maintain a generally constant pressure of LO to the sump independent of an attitude of the aerial vehicle with respect to gravitational force.

Embodiment 3. The lubrication system of any one or more of the embodiments, wherein the ingress port of the IC is configured to receive LO at a first pressure, $P_1$, wherein the overflow port is configured to dispense LO at a second pressure $P_2$, wherein the supply port is configured to dispense LO at a third pressure, $P_3$, and wherein $P_1$ is generally equal to a sum of $P_2$ and $P_3$.

Embodiment 4. The lubrication system of any one or more of the embodiments, wherein the sump comprises a first egress port and a second egress port, wherein the first and second egress ports are disposed on generally opposite sides of the sump, and wherein the ingress port of the IC is in fluid communication with both the first and second egress ports of the sump.

Embodiment 5. The lubrication system of any one or more of the embodiments, wherein the first egress port is coupled to the IC through a first fluid passageway, wherein the second egress port is coupled to the IC through a second fluid passageway, wherein the first fluid passageway comprises a first scavenge pump and the second fluid passageway comprises a second scavenge pump, wherein the first and second fluid passageways are in fluid communication with an oil-air separator configured to remove air from the LO, and wherein the oil-air separator is configured to provide the LO to the IC and vent air to an external environment.

Embodiment 6. The lubrication system of any one or more of the embodiments, wherein the LO tank comprises a makeup fluid circuit in fluid communication with the oil-air separator and configured to supply LO from the LO tank to the oil-air separator.

Embodiment 7. The lubrication system of any one or more of the embodiments, wherein the IC has a first internal volume, wherein the LO tank has a second internal volume, and wherein the first internal volume is less than the second internal volume.

Embodiment 8. The lubrication system of any one or more of the embodiments, wherein the IC is disposed at least partially within the LO tank.

Embodiment 9. The lubrication system of any one or more of the embodiments, wherein the lubrication system is retrofit in the aerial vehicle.

Embodiment 10. An aerial vehicle comprising: equipment comprising a sump configured to receive lubrication oil (LO); a lubrication system in fluid communication with the sump and configured to continuously supply LO to the sump at a generally constant pressure independent of an attitude of the aerial vehicle with respect to gravitational force.

Embodiment 11. The aerial vehicle of any one or more of the embodiments, wherein the lubrication system comprises an intake chamber (IC) in fluid communication with one or more egress ports of the sump, wherein the IC is configured to receive LO from the one or more egress ports of the sump at a first pressure, $P_1$, wherein the IC comprises: an overflow port in fluid communication with an LO tank configured to receive overflow LO from the IC, the overflow port being configured to dispense the overflow LO to the LO tank at a second pressure, $P_2$; and a supply port configured to supply LO to the sump at a third pressure, $P_3$, wherein $P_1$ is generally equal to a sum of $P_2$ and $P_3$.

Embodiment 12. The aerial vehicle of any one or more of the embodiments, wherein the overflow port is configured to pass a flow of LO into the LO tank at substantially all times during operation of the aerial vehicle.

Embodiment 13. The aerial vehicle of any one or more of the embodiments, wherein $P_2$ is variable, and wherein $P_3$ is generally constant.

Embodiment 14. The aerial vehicle of any one or more of the embodiments, wherein the lubrication system comprises: an oil-air separator configured to remove air from the LO after exiting the sump; a makeup fluid circuit configured to supply LO from an LO tank of the lubrication system to the oil-air separator; and a fluid passageway fluid coupling the oil-air separator to an intake chamber (IC) of the lubrication system and configured to provide LO to the IC.

Embodiment 15. The aerial vehicle of any one or more of the embodiments, wherein the generally constant pressure of LO supplied to the sump by the lubrication system is configured to deviate from a desired pressure by less than 1 pound per square inch (PSI) during operation of the aerial vehicle.

Embodiment 16. The aerial vehicle of any one or more of the embodiments, wherein the sump comprises a first egress port and a second egress port, wherein the first and second egress ports are disposed on generally opposite sides of the sump, and wherein the lubrication system is in fluid communication with both the first and second egress ports of the sump.

Embodiment 17. The aerial vehicle of any one or more of the embodiments, wherein the lubrication system is retrofit in the aerial vehicle.

Embodiment 18. A method of installing a lubrication system in an aerial vehicle, the method comprising: providing an intake chamber (IC) in the aerial vehicle such that an ingress port of the IC is in fluid communication with lubrication oil (LO) exiting a sump of an equipment of the aerial vehicle; fluidly coupling an overflow port of the IC to a LO tank of the aerial vehicle; and fluidly coupling a supply port of the IC to the sump, the IC being configured to supply LO to the sump.

Embodiment 19. The method of any one or more of the embodiments, wherein installing the IC is performed such that the IC is installed at least partially within the LO tank.

Embodiment 20. The method of any one or more of the embodiments, wherein installation of the IC is performed as a retrofit installation in an existing aerial vehicle.

What is claimed is:

1. A lubrication system for an aerial vehicle, the lubrication system comprising:

a lubrication oil (LO) tank configured to operate at a first internal pressure; and an intake chamber (IC) configured to operate at a second internal pressure greater than the first internal pressure, the IC comprising:

an ingress port configured to receive LO from a sump of an equipment of the aerial vehicle, wherein the sump comprises a first egress port and a second egress port, wherein the first and second egress ports are disposed on generally opposite sides of the sump, and wherein the ingress port of the IC is in fluid communication with both the first and second egress ports of the sump;

an overflow port in fluid communication with the LO tank; and a supply port in fluid communication with the sump and configured to supply LO to the sump;

a makeup fluid circuit having a first makeup fluid passageway and a second makeup fluid passageway in fluid communication with the LO tank at generally opposite sides of the LO tank; and an air-oil separator in fluid communication with the first and second fluid passageways and the first and second makeup fluid passageways, and wherein the oil-air separator is configured to provide the LO to the IC and vent air to an external environment.

2. The lubrication system of claim 1, wherein the IC is configured to maintain a generally constant pressure of LO to the sump independent of an attitude of the aerial vehicle with respect to gravitational force.

3. The lubrication system of claim 1, wherein the ingress port of the IC is configured to receive LO at a first pressure, $P_1$, wherein the overflow port is configured to dispense LO at a second pressure $P_2$, wherein the supply port is configured to dispense LO at a third pressure, $P_3$, and wherein $P_1$ is generally equal to a sum of $P_2$ and $P_3$.

4. The lubrication system of claim 1, wherein the first egress port is coupled to the IC through a first fluid passageway, wherein the second egress port is coupled to the IC through a second fluid passageway, wherein the first fluid passageway comprises a first scavenge pump and the second fluid passageway comprises a second scavenge pump, wherein the first and second fluid passageways are in fluid communication with an oil-air separator configured to remove air from the LO, and wherein the oil-air separator is configured to provide the LO to the IC and vent air to an external environment.

5. The lubrication system of claim 1, wherein the IC has a first internal volume, wherein the LO tank has a second internal volume, and wherein the first internal volume is less than the second internal volume.

6. The lubrication system of claim 1, wherein the IC is disposed at least partially within the LO tank.

7. The lubrication system of claim 1, further comprising a rotating inlet pick up disposed within the IC and fluidly coupled to the supply port, the rotating inlet pick up configured to rotate about a pivot point through gravitational forces.

8. An aerial vehicle comprising:

a lubrication system, the lubrication system comprising:

a lubrication oil (LO) tank configured to operate at a first internal pressure; and an intake chamber (IC) configured to operate at a second internal pressure greater than the first internal pressure, the IC comprising:

an ingress port configured to receive LO from a sump of an equipment of the aerial vehicle, wherein the sump comprises a first egress port and a second egress port, wherein the first and second egress ports are disposed on generally opposite sides of the sump, and wherein the ingress port of the IC is in fluid communication with both the first and second egress ports of the sump;

an overflow port in fluid communication with the LO tank; and a supply port in fluid communication with the sump and configured to supply LO to the sump;

a makeup fluid circuit having a first makeup fluid passageway and a second makeup fluid passageway in fluid communication with the LO tank at generally opposite sides of the LO tank; and an air-oil separator in fluid communication with the first and second fluid passageways and the first and second makeup fluid passageways, and wherein the oil-air separator is configured to provide the LO to the IC and vent air to an external environment.

9. The aerial vehicle of claim 8, wherein the IC is configured to receive LO from the one or more of the first egress ports and the second egress port of the sump at a first pressure, $P_1$, wherein the IC comprises:

an overflow port in fluid communication with the LO tank, wherein the LO tank is configured to receive overflow LO from the IC, the overflow port being configured to dispense the overflow LO to the LO tank at a second pressure, $P_2$; and a supply port configured to supply LO to the sump at a third pressure, $P_3$, wherein $P_1$ is generally equal to a sum of $P_2$ and $P_3$.

10. The aerial vehicle of claim 9, wherein the overflow port is configured to pass a flow of LO into the LO tank at substantially all times during operation of the aerial vehicle.

11. The aerial vehicle of claim 9, wherein $P_2$ is variable, and wherein $P_3$ is generally constant.

12. The aerial vehicle of claim 8, wherein the generally constant pressure of LO supplied to the sump by the lubrication system is configured to deviate from a desired pressure by less than 1 pound per square inch (PSI) during operation of the aerial vehicle.

13. The aerial vehicle of claim 8, wherein the lubrication system is retrofit in the aerial vehicle.

* * * * *